US007628682B2

(12) United States Patent
Andrasic et al.

(10) Patent No.: US 7,628,682 B2
(45) Date of Patent: Dec. 8, 2009

(54) SAFETY GUARD WITH CLAMPING DEVICE

(75) Inventors: Sinisa Andrasic, Schoenaich (DE); Cornelius Boeck, Kirchheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/995,134

(22) PCT Filed: Nov. 3, 2006

(86) PCT No.: PCT/EP2006/068083

§ 371 (c)(1),
(2), (4) Date: Jan. 9, 2008

(87) PCT Pub. No.: WO2007/073970

PCT Pub. Date: Jul. 5, 2007

(65) Prior Publication Data

US 2008/0207098 A1 Aug. 28, 2008

(30) Foreign Application Priority Data

Dec. 23, 2005 (DE) ..... 10 2005 061 867

(51) Int. Cl.
*B24B 55/04* (2006.01)

(52) U.S. Cl. ..... 451/451; 451/359; 451/454

(58) Field of Classification Search ..... 451/344, 451/357, 359, 451, 454, 455
See application file for complete search history.

(56) References Cited

U.S. PATENT DOCUMENTS

| | | | | |
|---|---|---|---|---|
| 5,351,368 | A | 10/1994 | Borst | |
| 6,464,573 | B1 * | 10/2002 | Keller | 451/451 |
| 6,988,939 | B2 | 1/2006 | Hofmann et al. | |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 | 3/2006 | Wiker | |

FOREIGN PATENT DOCUMENTS

| | | |
|---|---|---|
| DE | 101 24 439 | 11/2002 |
| DE | 102 35 923 | 2/2004 |
| DE | 102 59 520 | 7/2004 |
| DE | 103 43 060 | 4/2005 |
| WO | 92/00834 | 1/1992 |

* cited by examiner

*Primary Examiner*—Eileen P. Morgan
(74) *Attorney, Agent, or Firm*—Michael J. Striker

(57) ABSTRACT

The invention relates to a protective hood for a portable tool with a rotary tool, having a clamping device designed as a clamping ring for fastening to a machine neck of the portable tool, and having an anti-rotation locking means for fixing the angular position of the protective hood relative to the portable tool. It is proposed that at least one rotation-locking element (19) which can interact with a rotation-locking element (19) of the machine neck be arranged in a fixed position on the clamping ring (7) for forming the anti-rotation locking means. A portable tool having such a protective hood (1) is also proposed.

12 Claims, 1 Drawing Sheet

SAFETY GUARD WITH CLAMPING DEVICE

CROSS-REFERENCE TO RELATED APPLICATION

The invention described and claimed hereinbelow is also described in German Patent Application DE 10 2005 061 867.7 filed on Dec. 23, 2005. This German Patent Application, whose subject matter is incorporated here by reference, provides the basis for a claim of priority of invention under 35 U.S.C. 119(*a*)-(*d*).

BACKGROUND OF THE INVENTION

Safety guards for rotating tool-equipped hand-guided power tools such as angle grinders are known. Such safety guards have a coverage region that covers the rotating tool and have a rotating tool clearance region. The coverage region serves to protect the operator from shavings and flying sparks as well as from shards of a shattered rotating tool, for example a grinding disk. In order for the rotating tool clearance region to be situated in a favorable position in relation to the work piece as a function of the field in which the hand-held power tool is being used and the work attitude of the operator, it is known to embody the safety guard so that it can be mounted in various angular positions in relation to the hand-guided power tool. To this end, clamping devices embodied in the form of clamping rings are known, which are used to attach the guard to a machine collar of the hand-guided power tool. DE 102 59 520 has also disclosed a rotation-preventing mechanism for fixing the angular position of the safety guard in relation to the hand-guided power tool. The disadvantage of this mechanism is that the clamping device is designed so that releasing and attaching the safety guard to the machine collar of the hand-guided power tool requires a tool, while the angular position of the safety guard is fixed by means of a lever clamping mechanism provided with a detent pawl situated on a clamping lever serving as a rotation-preventing means. Such a safety guard is complex to use.

SUMMARY OF THE INVENTION

In view of this prior art, the present invention discloses a safety guard for a hand-guided power tool with a rotating tool, having a clamping device embodied in the form of a clamping ring for attaching to a machine collar of the hand-guided power tool and having a rotation-preventing means for fixing the angular position of the safety guard in relation to the hand-guided power tool, in which at least one rotation-securing element, which is able to cooperate with a rotation-securing counterpart element of the machine collar, is situated in stationary fashion on the clamping ring in order to constitute the rotation-prevention means. This embodiment produces a rotation-prevention means on the clamping ring itself. The expression "able to cooperate" means that it permits the operator to produce a connection, in particular an operative connection.

According to another embodiment, the rotation-securing element is embodied in the form of a raised projection and the rotation-securing counterpart element is embodied in the form of a recess. This achieves a uniquely defined association, for example by means of detent engagement.

According to another embodiment, the rotation-securing element is embodied in the form of a recess and the rotation-securing counterpart element is embodied in the form of a raised projection. This achieves a uniquely defined association like the one above, but with the opposite geometry.

According to another embodiment, the clamping ring is embodied in the form of an open clamping ring. This means that the clamping ring is not intrinsically closed, but instead has an opening to allow its circumference to be changed. For the attachment of the safety guard to the machine collar, this opening can be closed by means of a closing device, for example a screw-connection and/or a lever mechanism.

According to another embodiment, at least part of the clamping ring is embodied in the form of a clamping strap. The term "clamping strap" is essentially understood to be an elastic or resilient embodiment, for example is embodied in the form of a leaf spring, a reversibly deformable sheet metal part, or the like. This produces a region of the clamping ring with a form that is always the same shape, regardless of whether the clamping ring is open or closed, and one that is variably shaped, namely the one embodied in the form of the clamping strap.

According to another preferred embodiment, the clamping ring is equipped with a lever-operated clamping device. A lever-operated clamping device is essentially a clamping device in which a lever is linked to one end region of preferably open clamping ring by means of one rotation axis of the lever and, within the region of the lever, there is another axis in the region of which the other end of the clamping ring is linked so that when the lever is opened, this opens the clamping device and when the lever is closed, this closes the clamping device.

According to another preferred embodiment, the clamping ring has a spring element on its inner wall. With such a spring element, when the clamping device is opened, the inner surface of the clamping ring lifts away from the outer surface of the machine collar due to the spring force of the spring element because the spring element on the clamping ring exerts a spring force on the outer wall of the machine collar, thus pressing the clamping ring away from it.

According to another preferred embodiment, the spring element is embodied in the form of a leaf spring or bow spring. This embodiment, preferably with a convex arc oriented toward the machine collar, represents an easy-to-manufacture, highly effective embodiment of the spring element According to another preferred embodiment, the spring width of the spring element is less than the ring height of the clamping ring. This means that the spring width of the spring element is less than the ring height of the clamping ring in the axial direction. As a result, the spring does not exert spring force on the entire width of the clamping ring, but only in a region of it.

According to another particularly preferred embodiment, the spring element can be made to cooperate with recesses and/or at least one annular groove let into the machine collar. This means that the machine collar has recesses and/or an annular groove in which the spring element engages when the clamping device is correctly positioned. This makes it possible to provide a coding that permits safety guards equipped with the clamping device to be specifically associated with certain machine types, for example in order to prevent a safety guard from being used on a machine, which, although it does in fact have an identical or quite similar machine collar, operates at a higher speed and therefore would not be approved for use with the safety guard.

According to another preferred embodiment, the rotation-securing element is embodied in the form of a trapezoidal tooth. The expression "in the form of a trapezoidal tooth" means that the cross section of the rotation-securing element is the shape of a trapezoidal tooth. This makes it possible to achieve a simple detent engagement or locking in the corresponding rotation-securing counterpart element, thus permitting the rotation-securing element to slide easily in and out of the rotation-securing counterpart element during a rotating movement when the clamping ring is released.

According to another preferred embodiment, the rotation-securing element is embodied in the form of a tooth that is trapezoidal on one side. This makes it possible to allow the safety guard to rotate easily in one direction when the clamping ring is open, but to produce a locking action that prevents it from rotating in the other direction. As above, this assures an easy sliding action into and out of the corresponding rotation-securing counterpart element(s).

According to a preferred embodiment, the embodiment in the form of a unilaterally trapezoidal tooth has a steeply inclined section that is oriented toward the opening. This means that the gradually inclined part of the unilaterally trapezoidal tooth is oriented away from the opening while the steeply inclined part of the trapezoidal tooth is oriented toward the opening. By means of the force curve that this produces, this embodiment assures that even in the event of powerful vibrations, the clamping strap cannot come loose and in particular, the rotation-securing element cannot slide out from the rotation-securing counterpart element, which would cause the safety guard to slip and, in the worst-case scenario, to come off. This embodiment can also be arranged in mirror image fashion to the one suggested above (i.e. with the steeply inclined section oriented away from the opening in this case); this, however, is not quite as advantageous.

According to another preferred embodiment, a plurality of rotation-securing elements with raised protrusions of different heights are provided on the inside of the clamping ring. This means that a plurality of the above-mentioned rotation-securing elements are situated inside the clamping ring in different positions within the axial span (in relation to the imaginary axis of the rotating tool).

A particularly preferred embodiment has a plurality of rotation-securing elements with raised protrusions of different heights that have a rising height profile. This means that the height/span of each rotation-securing element inside the clamping ring is greater than the height of the rotation-securing element preceding it. This achieves an increasing height geometry of the rotation-securing elements that permits an easy, desired sliding with only a slight opening of the clamping ring, but nevertheless assures a secure and complete engagement.

According to another embodiment, the rotation-securing element is cylindrically embodied. These elements can be embodied in the form of cylinders that protrude up from the clamping ring, i.e. cylinders whose axes extend perpendicular to the inside wall of the clamping ring and therefore in the radial direction, or can also be embodied in the form of cylinders that extend in the axial direction, e.g. situated in a partially recessed arrangement. It is only important that a uniquely defined, secure engagement occurs when the clamping ring is closed, as well as a uniquely defined position association in a certain angular position.

The invention also includes a hand-guided power tool with a machine collar; the machine collar has at least one rotation-securing counterpart element that cooperates with at least one rotation-securing element. This makes it easy to establish a system of hand-guided power tools and corresponding safety guards in which different machine types have different designs of, for example, spring elements, rotation-securing elements, etc. with regard to the above-described codings.

The invention will be explained in greater detail below in conjunction with the drawing.

DESCRIPTION OF THE PREFERRED EMBODIMENTS

Figure 1:
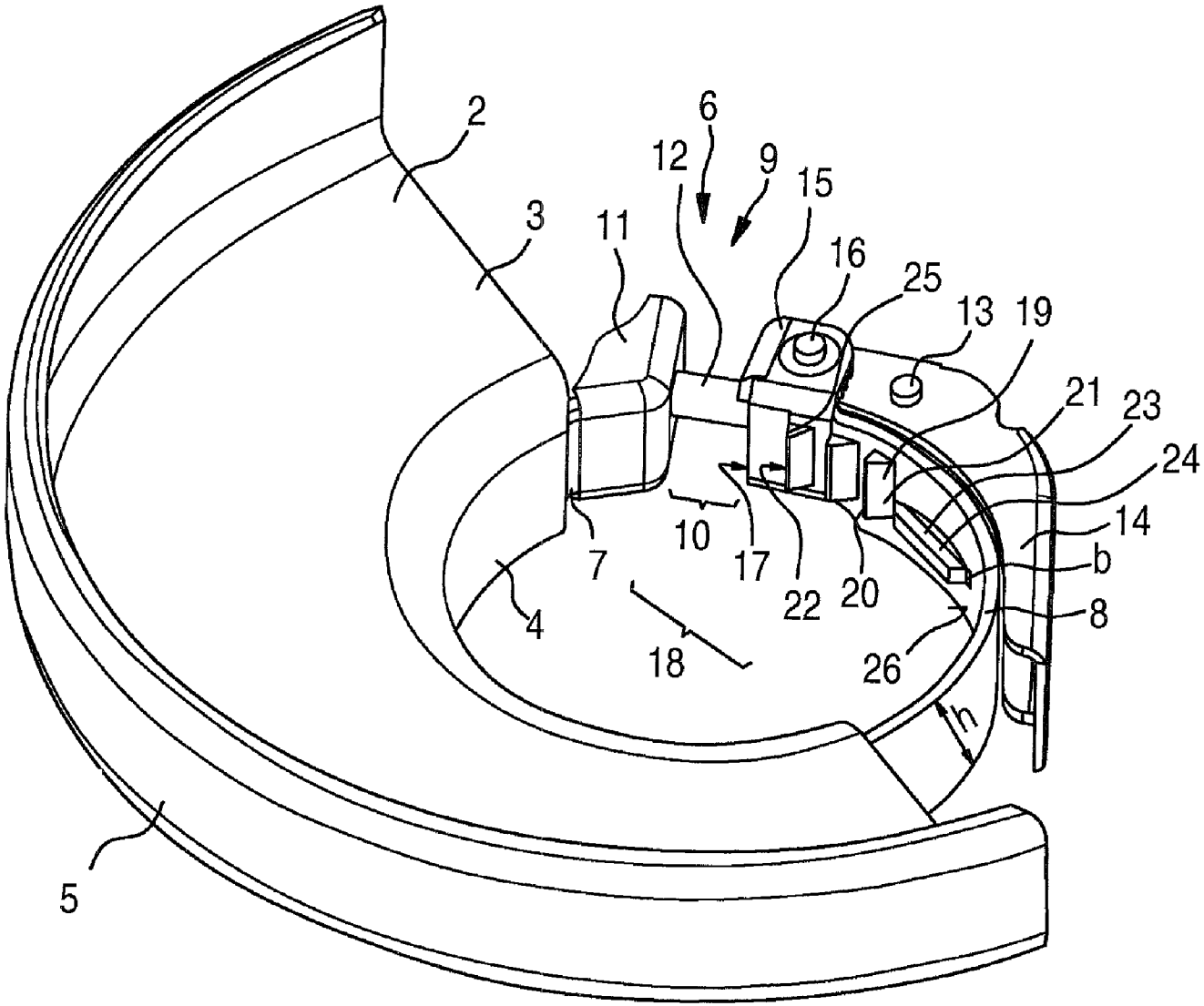
FIG. 1 shows a safety guard with a clamping device.

FIG. 1 depicts a safety guard 1 for a hand-guided power tool that is not shown. The safety guard has a guard body 2 composed of an axial wall 3 that is integrally joined to a collar 4 at its inner circumference and integrally joined to a skirt 5 at its outer circumference. The guard body 2 essentially constitutes a semicircular ring segment, with the collar 4 delimiting the axial wall on the inner circumference side and the skirt 5 delimiting the axial wall on the outer circumference side. The collar 4 and skirt 5 are angled away from the axial wall 3 in opposite directions, each by an approximately 90° angle. The collar 4 is encompassed by a clamping device 6. The clamping device 6 is composed of a clamping ring 7 and a clamping strap 8; the clamping ring 7 is embodied in the form of an open clamping ring 9. The clamping ring 7 has an opening 10 whose one end has a bearing bracket 11 attached to it, into which a clamping pin 12 is inserted in order to bridge the opening 10 and, at the other end of the clamping ring 7, which is embodied in the form of a clamping strap 8, this clamping pin 12 is attached with frictional engagement to an actuating handle 14 by means of a lateral pin 13 that is inserted into the clamping ring perpendicular to its longitudinal axis. In a second bearing bracket 15, the actuating handle 14 is linked to the opening end 17 of the clamping strap 8 by means of a second lateral pin 16. The actuating handle 14 cooperates with the bearing bracket 11, the clamping pin 12, the lateral pin 13, the second bearing bracket 15, and the second lateral pin 16 to form a lever-actuated clamping device 18 spanning the opening 10. In the region of the clamping strap 8, the clamping ring 7 is equipped with stationery rotation-securing elements 19. These are each embodied in the form of a unilaterally trapezoidal tooth 20 in the form of a raised protrusion 25 projecting in from the inside of the clamping strap 8, which means that the cross section of each rotation-securing element 19 forms a unilaterally trapezoidal tooth 20, with the gradually inclined side 21 of each unilaterally trapezoidal tooth 20 being oriented away from the opening 10 so that the steeply inclined section 22 of each unilaterally trapezoidal tooth 20 is oriented toward the opening 10. Together with rotation-securing counterpart elements, not shown, on the machine collar, not shown, into which the rotation-securing element are able to engage in a form-locking fashion, these constitute a rotation-preventing means and constitute an angular position locking mechanism if the number of rotation-securing counterpart elements is greater than the number of rotation-securing elements. The clamping strap 8 is also provided with a spring element 23 whose longitudinal span projects up along the inner circumference wall 26 of the clamping strap 8. The width b of the spring element 23 (narrow side) here is less than the height h of the clamping strap 8. The placement of the spring element 23 in the region of a different axial span in the height h of the clamping ring 8, together with an annular groove or other measures, not shown, provided on the machine collar, not shown, makes it possible to establish a coding system that permits the safety guard 1 to be used only with those machines for whose specifications (in particular maximum speed) the safety guard has been designed and approved.

In lieu of a spring element 23, it is also possible to provide a device in the form of a lug 24 that is integrally joined to the clamping strap 8. The key thing is that a lug-shaped element, which has a certain width b as an axial span, is positioned definitely in the region of the height h of the clamping ring 8 so as to permit a definite association with a counterpart element on the machine collar.

When the clamping ring 7 is opened by means of the actuating handle 14 and the clamping strap 8 is thus released/loosened, the radius of the clamping ring increases so that the clamping ring, together with the safety guard 1, can be slid on over the machine collar that is not shown. In order to attach the safety guard 1 to the machine collar, the actuating handle 14 must be closed, thus reducing the radius of the clamping ring again and causing the rotation-securing elements 19 to engage in the rotation-securing counterpart elements, not shown, of the machine collar, not shown, and also causing the spring element 23 and/or the lug 24 to engage in a counterpart element, not shown, for example an annular groove, not shown, in the machine collar, not shown. Only if this engagement occurs in the proper fashion, i.e. when each rotation-securing element is situated opposite a corresponding rotation-securing counterpart element and also the spring element 23 and/or the lug 24 is situated opposite a corresponding counterpart element, not shown, can the clamping ring 7 close and fasten the safety guard 1 to the machine collar. For an initial setting of the correct circumference for the respective machine collar, it is possible to provide an adjusting screw, not shown here, in the region of the clamping pin 12 and preferably also of the bearing bracket 11, for example by embodying the clamping pin 12 in the form of a threaded pin/screw. This enables a fine adjustment of the clamp diameter. In order to remove the safety guard 1 from the machine collar, the actuating handle 14 is opened, causing the rotation-securing elements 19 to be released from the corresponding rotation-securing counterpart elements and causing the spring element 23 and/or the lug 24 to be released from the respective counterpart element. Furthermore, in the embodiment of the spring element 23, the exertion of a spring force on the clamping ring 8 in the direction of the rotation axis of the rotating tool, not shown, in the machine collar, causes the clamping ring 7 to open. The rotation-securing elements thus disengage from the respective rotation-securing counterpart elements while the spring element 23 and/or lug 24 disengage(s) from the respective counterpart element, permitting the safety guard 1 to be removed from the machine collar.

By providing a multitude of rotation-securing counterpart elements on the machine collar, not shown, it is possible, after the opening of the clamping ring 7 (namely through actuation of the actuating handle 14), to bring the safety guard into different angular positions in relation to the hand-guided power tool; this is possible within a range in which the rotation-securing elements 19 correspond to the rotation-securing counterpart elements, not shown. In places on the machine collar that are not provided with such rotation-securing counterpart elements, the rotation-securing elements 19 are unable to engage, thus making it impossible for the clamping ring to close and preventing such an incorrect attachment of the safety guard.

If a plurality of rotation-securing elements 19 are embodied with raised protrusions 25 of different heights in such a way that the raised protrusion 25 rises or falls with each successive rotation-securing element 19, thus producing a rising or falling height profile, then this advantageously enables a favorable, secure adjustment while producing only a slight opening of the clamping ring 7. The safety guard 1, however, is prevented from inadvertently coming loose from the machine collar, not shown, and at the same time, a reliable engagement in the rotation-securing counterpart elements, not shown, is assured at all times.

What is claimed is:

1. A safety guard for a hand-guided power tool provided with a rotating tool, the safety guard comprising a clamping device configured as a clamping ring for attachment to a machine collar of the hand-guided power tool; a rotation-preventing means for fixing an angular position of the safety guard in relation to the hand-guided power tool, wherein the rotation-preventing means includes at least three rotation-securing elements (19) that are configured as protrusions (25) of different heights arranged from lowest to highest height, are cooperatable with a rotation-securing counterpart recess element of the machine collar and are situated in stationary fashion on the clamping ring (7) in order to constitute the rotation-prevention means, wherein the clamping ring (7) is equipped with a lever-operated clamping device (18) for reducing and increasing a radius of the clamping ring (7).

2. The safety guard as recited in claim 1, wherein the clamping ring (7) has an opening (10).

3. The safety guard as recited in claim 1, wherein at least part of the clamping ring (7) is embodied in the form of a clamping strap (8).

4. The safety guard as recited in claim 1, wherein the clamping ring (7) has an inner wall and a spring element (23) on the inner wall.

5. The safety guard as recited in claim 4, wherein the spring element (23) is embodied in the form of a leaf spring or bow spring.

6. The safety guard as recited in claim 4, wherein a width of the spring element (23) is less than a height of the clamping ring (7) in an axial direction of the safety guard.

7. The safety guard as recited in claim 4, wherein the spring element (23) is cooperatable with recesses and/or at least one annular groove provided in the machine collar.

8. The safety guard as recited in claim 1, wherein each rotation-securing element (19) is configured as a trapezoidal tooth.

9. The safety guard as recited in claim 1, wherein each rotation-securing element (19) is configured as a tooth that is trapezoidal on one side.

10. The safety guard as recited in claim 9, wherein the tooth is configured as a unilaterally trapezoidal tooth with a steeply inclined section (22) that is oriented toward the opening (10).

11. The safety guard as recited in claim 1, wherein each rotation-securing element (19) is cylindrical.

12. A hand-guided power tool provided with a rotating tool, the power tool equipped with a machine collar, and a safety guard comprising a clamping device configured as a clamping ring for attachment to the machine collar of the hand-guided power tool; a rotation-preventing means for fixing an angular position of the safety guard in relation to the hand-guided power tool, wherein the rotation-preventing means includes at least three rotation-securing elements that are configured as protrusions of different heights arranged from lowest to highest height, are cooperatable with a rotation-securing counterpart recess element of the machine collar and are situated in stationary fashion on the clamping ring in order to constitute the rotation-preventing means, wherein the clamping ring is equipped with a level-operated clamping device for reducing and increasing a radius of the clamping ring.

* * * * *